US007614116B2

(12) United States Patent
Chen et al.

(10) Patent No.: US 7,614,116 B2
(45) Date of Patent: Nov. 10, 2009

(54) MULTI-DIRECTIONAL ADJUSTMENT HINGE

(75) Inventors: Ken-Ching Chen, Kaohsiung Hsien (TW); Hsiu-Chiang Liang, Kaohsiung Hsien (TW); Ting-Tsai Huang, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 126 days.

(21) Appl. No.: 11/797,511

(22) Filed: May 4, 2007

(65) Prior Publication Data

US 2008/0271290 A1 Nov. 6, 2008

(51) Int. Cl.
*E05D 7/04* (2006.01)

(52) U.S. Cl. ..... 16/238

(58) Field of Classification Search ..... 16/238, 16/240, 242, 248, 254, 235
See application file for complete search history.

(56) References Cited

U.S. PATENT DOCUMENTS 4,716,622 A * 1/1988 DeBruyn ..... 16/297
5,027,474 A * 7/1991 Bowers ..... 16/297
6,393,663 B1 * 5/2002 Lin ..... 16/335
6,470,531 B2 10/2002 Domenig et al.
6,643,895 B1 11/2003 Domenig et al.
6,647,591 B1 11/2003 Domenig et al.
6,694,567 B1 * 2/2004 Domenig et al. ..... 16/238
6,779,233 B2 8/2004 Migli
6,845,544 B2 1/2005 Hofer
6,880,205 B2 4/2005 Rupprechter
7,231,691 B1 * 6/2007 Domenig et al. ..... 16/236
2006/0236503 A1 * 10/2006 Migli ..... 16/236

* cited by examiner

*Primary Examiner*—Victor Batson
*Assistant Examiner*—Rowland D Do
(74) *Attorney, Agent, or Firm*—Rosenberg, Klein & Lee

(57) ABSTRACT

A multi-directional adjustment hinge includes a head plate, a connector, a locating plate, a pivot pin, a spring tongue, a first adjustment cam, and a second adjustment cam. The arm is provided with a cam portion and an insertion portion. The cam portion of the arm is connected to the head plate. The connector has a connection plate and an extension plate. The insertion portion of the arm and the connection plate are interlocked and interacting with the first adjustment cam. The locating plate is connected to the extension plate. The locating plate and the extension plate are interlocked and interacting by means of the second adjustment cam. The spring tongue penetrates and engages with the arm.

4 Claims, 8 Drawing Sheets

MULTI-DIRECTIONAL ADJUSTMENT HINGE

BACKGROUND OF THE INVENTION (a) Field of the Invention

The present invention is related to a multi-directional adjustment hinge, and more particularly, to one provided with a stable combination structure of an adjustment mechanism and allowing compact and effective components.

(b) Description of the Prior Art

A furniture hinge commonly used to a cabinet is essentially comprised of a head plate, an extension arm, and a locating plate. The extension arm is pivoted to the head plate to become a movable part. The head plate is usually fixed to an object including a door plank. The extension arm is connected to the locating plate secured on the cabinet. An elastic member disposed in the head plate applies force on the extension arm to deliver a certain closing force when the door plank is pushed back to shut the cabinet.

The furniture hinge is further designed with a multi-directional adjustment in axes X, Y, and Z as taught in U.S. Pat. Nos. 6,470,531 B2, 6,643,895 B1, 6,647,591 B1, 6,694,567 B1, 6,779,233 B2, 6,845,544 B2, and 6,880,205 B2.

However, as taught in U.S. Pat. Nos. 6,643,895 B1, 6,694,567 B1 (a CIP of U.S. Pat. No. 6,643,895 B1), and U.S. Pat. No. 6,880,205 B2, a structure of combination provided at an adjustment cam is vulnerable to getting loosened up after prolonged use of the hinge; and Part 5 and Part 3 disclosed in U.S. Pat. No. 6,880,205 B2 make it more troublesome in assembly a pin is needed for connection.

SUMMARY OF THE INVENTION

The primary purpose of the present invention is to provide a multi-directional adjustment hinge to solve the problem of a loosening structure of the hinge adjustment, allowing more compact construction of the hinge and reducing production cost.

To achieve the purpose, the multi-directional adjustment hinge of the present comprises a head plate, a connector, a locating plate, a pivot pin, a spring tongue, a first adjustment cam, and a second adjustment cam. Wherein a chamber is disposed in the head plate; an arm with two opposite ends has one end designed as a cam portion and another end as an insertion portion; the arm has its cam portion penetrating into the chamber of the head plate to connect to the pivot pin; and the insertion portion of the arm is disposed with a first plate and a second plate on different levels. The connector plate includes a connection plate and an extension plate disposed perpendicularly to each other; and locking pieces separated from each other are disposed to the connection plate for receiving the insertion portion of the arm while the insertion portion of the arm and the connection plate are interlocked for interaction by means of the first adjustment cam. A hole is disposed at a central portion of the extension plate and a recess is provided next to the hole; and two sidewalls are provided to the extension plate with each sidewall disposed with a protruding tab. The locating plate has two lips and a raised portion; a flange is disposed to a terminal of each lip; the locating plate is inserted by means of the lips and the flanges to where between the sidewalls and the recess of the extension plate; each protruding tab from the sidewall holds against the flange of the lip; the raised portion is attached to the recess of the extension plate; and by means of the second adjustment cam, the raised portion and the recess of the extension plate interlock and interact with each other. The spring tongue is secured in the chamber of the head plate by means of a locating portion; and a force-applying portion is disposed to the spring tongue to penetrate through and hold against the arm.

Wherein, locating pieces and retainers are disposed in the chamber to hold against the locating portion of the spring tongue and the locating pieces compress the locating portion to secure the spring tongue in position.

Wherein, the retainers correspond in position to an edge of the locating portion of the spring tongue.

Wherein, the arm is formed with a slot next to the cam portion; and the force-applying portion of the spring tongue penetrates through the slot to hold against the cam portion.

Wherein, a raised surface is disposed to the connection plate of the connector at where corresponding to the first plate of the insertion portion of the arm; a first slit is disposed on the raised surface, a first through hole is disposed on the first plate of the insertion portion; the first adjustment cam is provided with a first riveting end and a first cam base; the first adjustment cam is linked with the first riveting end to the first through hole; and the first cam base extends into the first slit.

Wherein, a second slit is disposed on the recess of the extension plate; a second through hole is disposed on the raised portion of the locating plate; the second adjustment cam is provided with a second riveting end and a second cam; the second adjustment cam is linked with the second riveting end to the second through hole; and the second cam base extends into the second slit.

Wherein, two retaining tabs and a strip hole are disposed on one end of the locating plate.

When compared to the prior art, the present invention provides the following effects and advantages:

Both sidewalls of the extension plate of the connector are tightly inserted to both flanges from the two lips of the locating plate; each protruding tab is directly molded on each sidewall of the extension plate to be further locked to the flange of the lip to provide stable combination without any additional connection member.

DETAILED DESCRIPTION OF THE PREFERRED EMBODIMENTS

Figure 1:
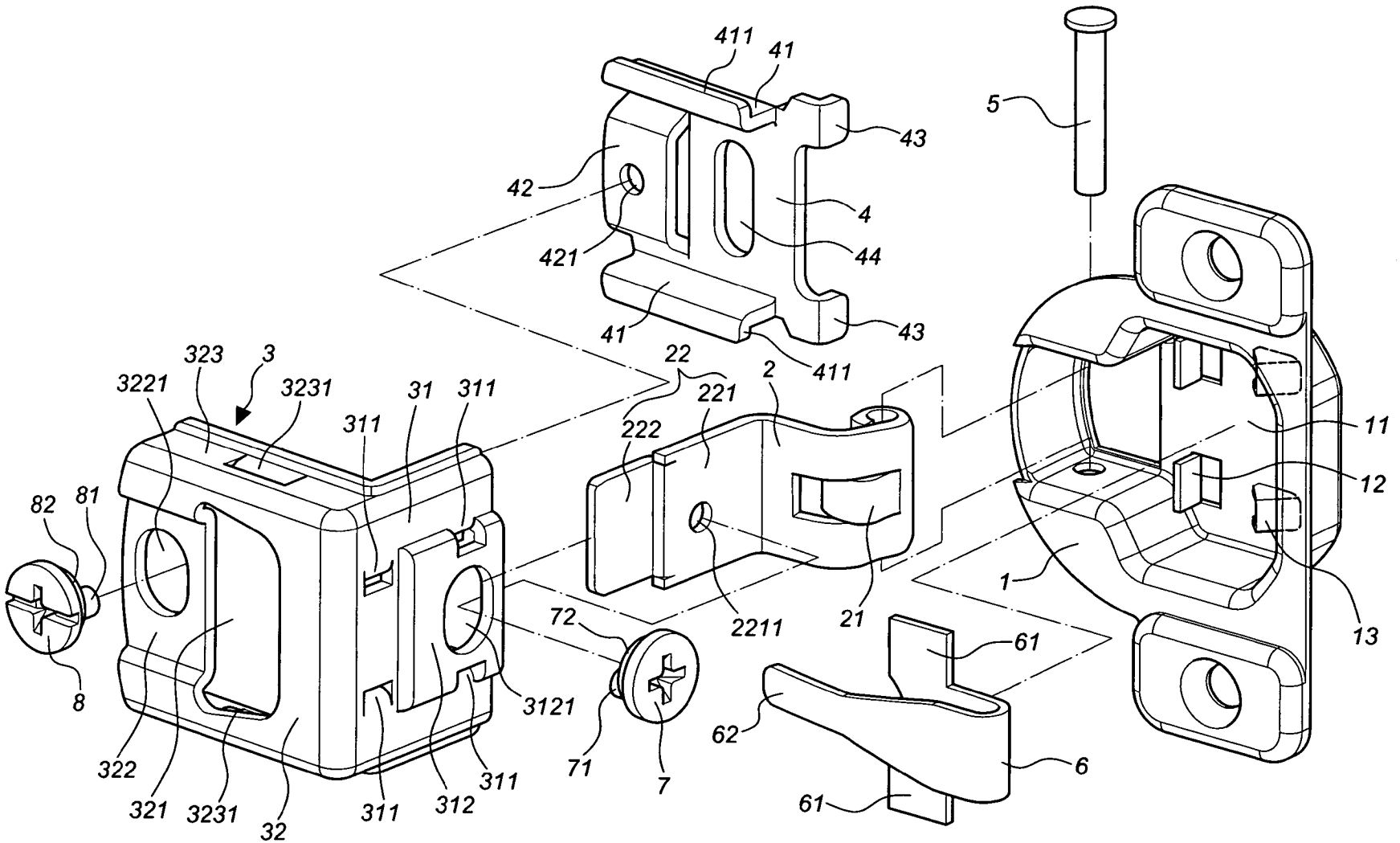
FIG. 1 is an exploded view of a preferred embodiment of the present invention (locating pieces not yet bent).
Figure 2:
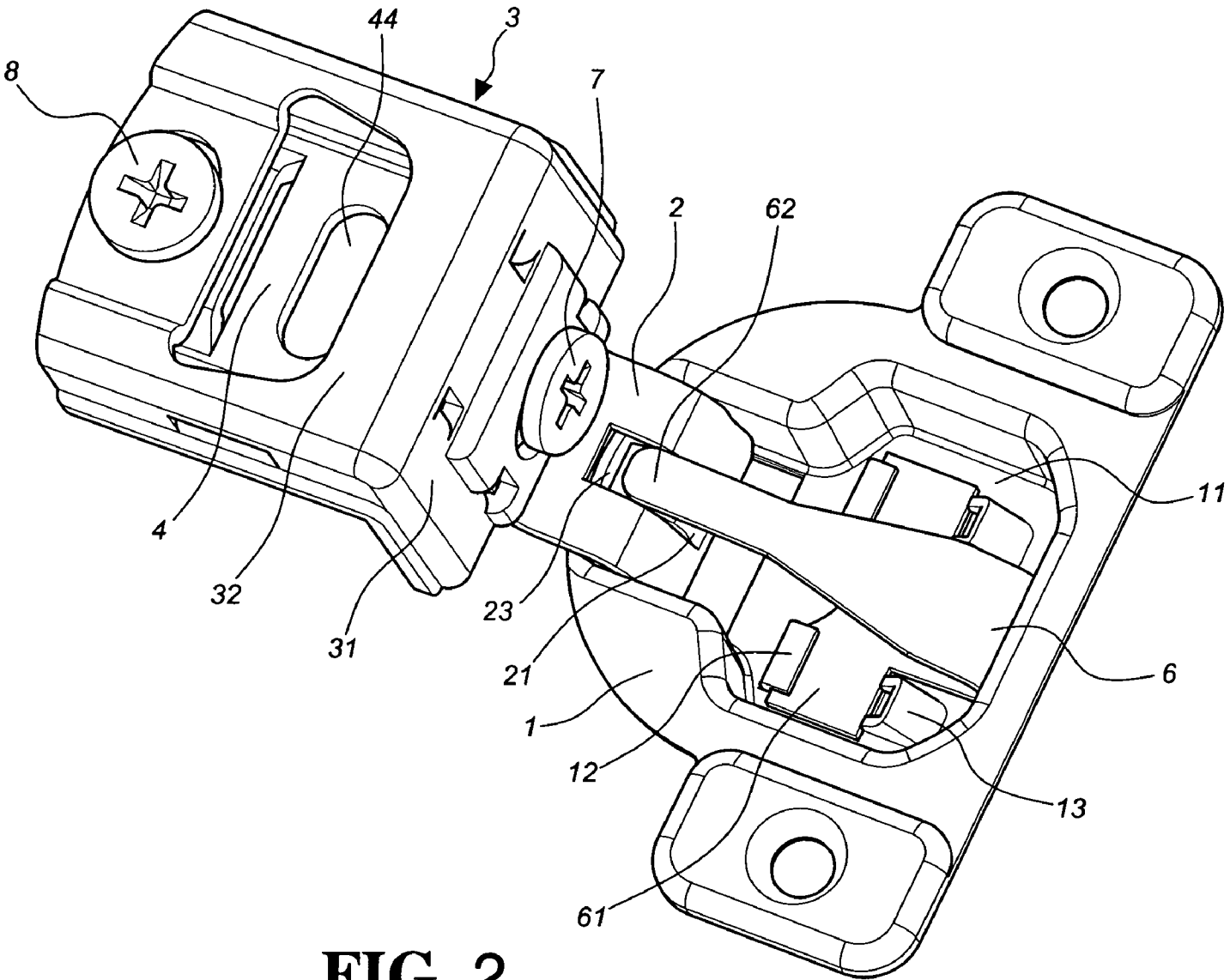
FIG. 2 is a perspective view showing the present invention as assembled.

Referring to FIGS. 1 and 2, a preferred embodiment of the present invention comprises a head plate (1), an arm (2), a connector (3), a locating plate (4), a pivot pin (5), a spring tongue (6), a first adjustment cam (7), and a second adjustment cam (8).

A chamber (11) is disposed in the head plate (1), and the bottom of the chamber (11) is disposed with locating pieces (12) and retainers (13).

The arm (2) related to a bent plate with two opposite ends has one end designed as a cam portion (21) and another end as an insertion portion (22). The insertion portion (22) of the arm (2) is disposed with a first plate (221) and a second plate (222) on different levels. A slot (23) is disposed to the arm (2) next to the cam portion (21). A first through hole (2211) is provided on the first plate (221) of the insertion portion (22).

Figure 3:
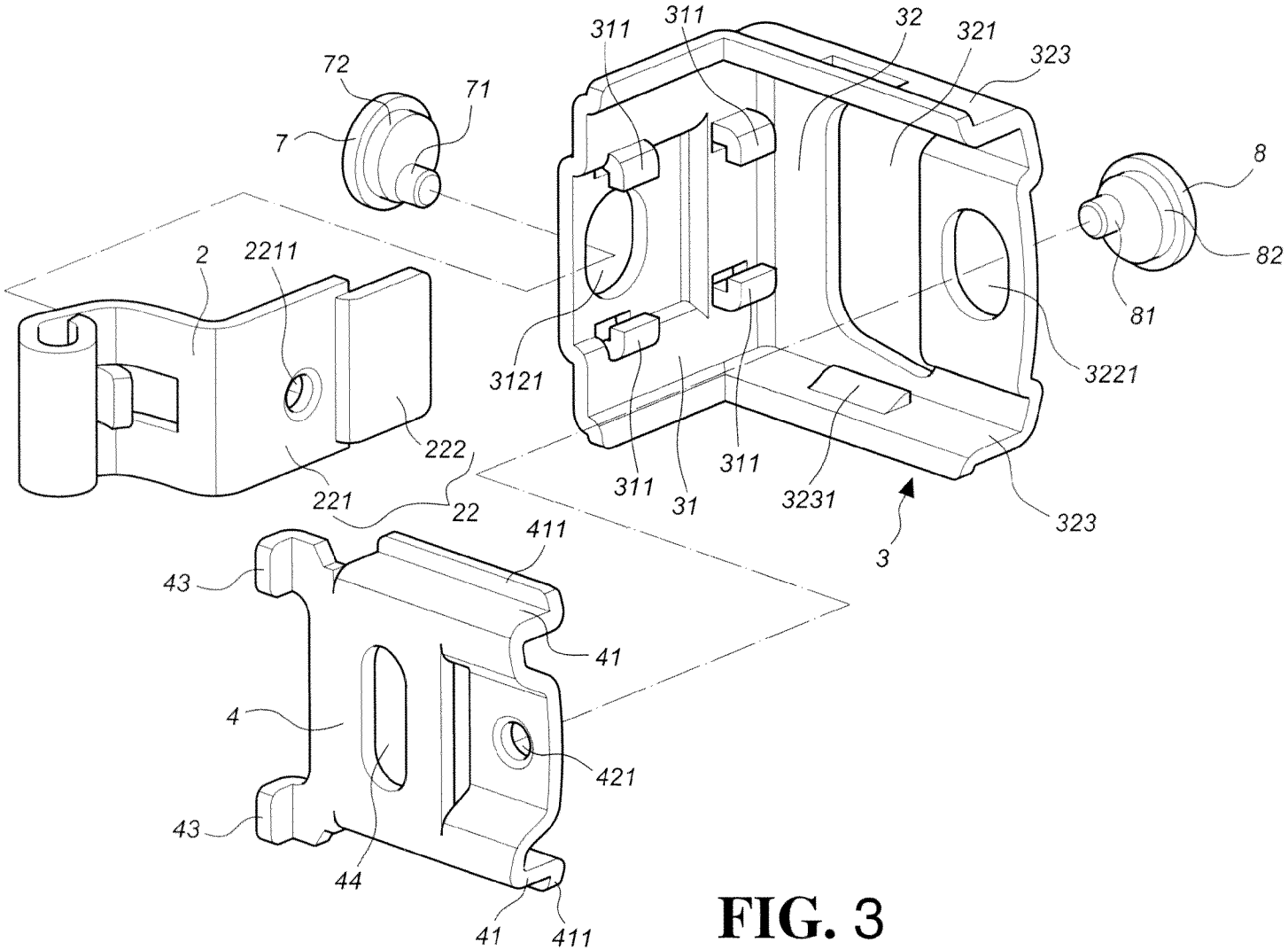
FIG. 3 is another exploded view showing the preferred embodiment of the present invention including an arm, a connector, a locating plate, a first adjustment cam, and a second adjustment cam.

The connector (3) (also referring to FIG. 3) has a connection plate (31) and an extension plate (32) disposed perpendicular to each other. Two pairs of locking pieces (311) separated from each other are disposed to the connection plate (31) for receiving the insertion portion (22) of the arm (2). A raised surface (312) is provided between the two pairs of locking pieces (311) of the connection plate (31). A first slit (3121) is disposed on the raised surface (312). A hole (321) is disposed at a central portion of the extension plate (32). A recess (322) is provided next to the hole (321). A second slit (3221) is disposed on the recess (322). Two sidewalls (323) are provided to the extension plate (32) with each sidewall (323) inwardly disposed with a protruding tab (3231).

Figure 4:
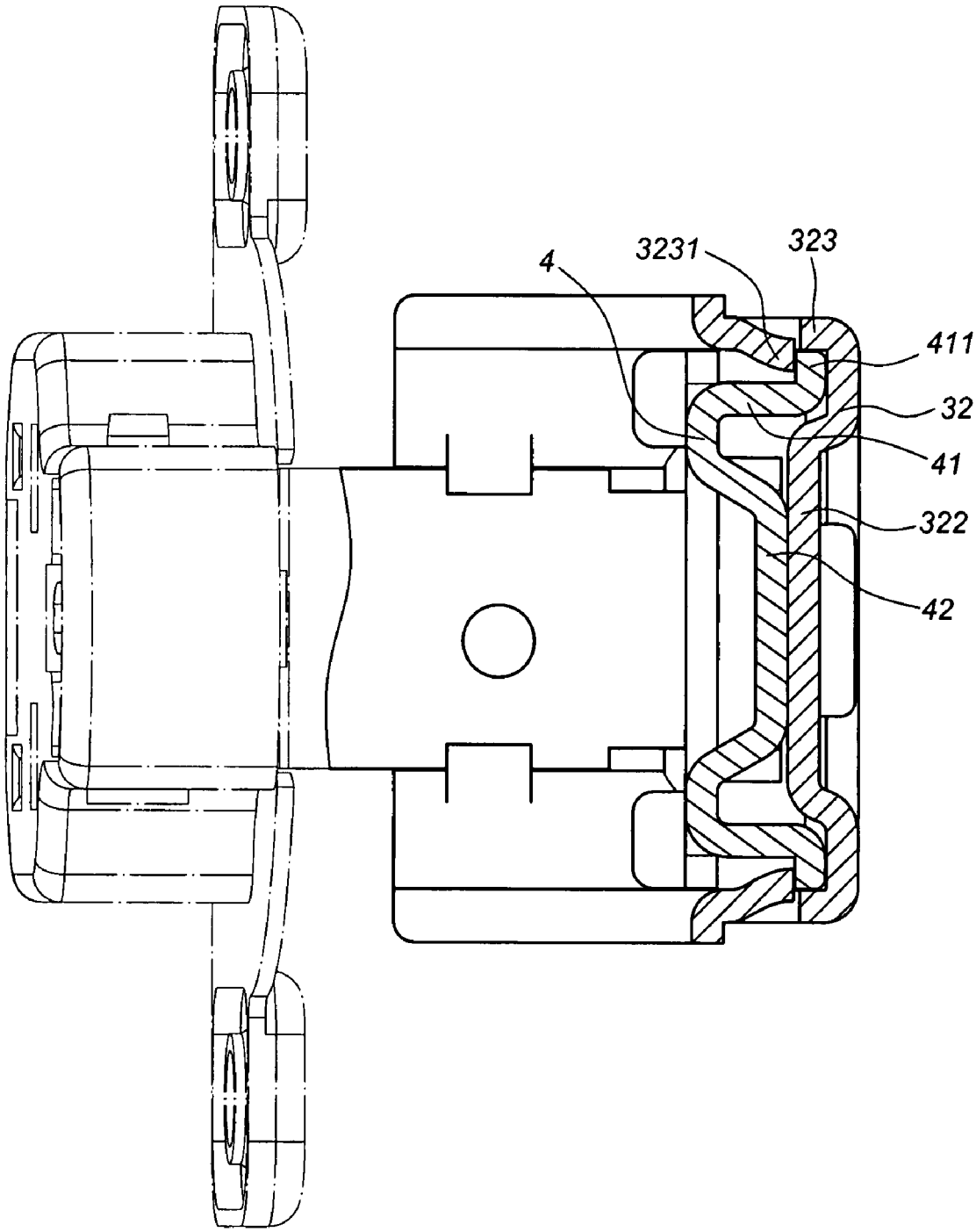
FIG. 4 is a sectional view showing a combination of the connector and the locating plate of the preferred embodiment of the present invention.

The locating plate (4) is provided with two lips (41) at two sides of the locating plate (4). A flange (411) is bent from a terminal of each lip (41). A raised portion (42) is provided between the two lips (41). A second through hole (421) is disposed on the raised portion (42). The locating plate (4), as illustrated in FIG. 4, is inserted by means of the lips (41) and the flanges (411) to where between the sidewalls (323) and the recess (322) of the extension plate (32). Each protruding tab (3231) of the sidewall (323) holds against the flange (411) of the lip (41). The raised portion (42) is laid flushed against the recess (322) of the extension plate (32). Two retaining tabs (43) and a strip hole (44) are disposed on one end of the locating plate (4).

The pivot pin (5) is provided to penetrate through the cam portion (21) of the arm (2) and the head plate (1) so as to pivot the arm (2) to the head plate (1).

The spring tongue (6) includes a locating portion (61) and a force-applying portion (62). The locating portion (61) is attached to the bottom of the chamber (11) of the head plate (1). The retainers (12) hold against an edge of the locating portion (61) and the locating pieces (13) compress the locating portion (61) to secure the spring tongue (6) in position. The force-applying portion (62) penetrates through the slot (23) of the arm (2) to compress against the cam portion (21).

The first adjustment (7) penetrates the connection plate (31) between the locking pieces (311) to link to the first plate (221) of the insertion portion (22) of the arm (2). The first adjustment cam (7) is provided with a first riveting end (71) and a first cam base (72). The first riveting end (71) is linked to the first through hole (2211) of the arm (2), and the first cam base (72) extends into the first slit (3121) of the connection plate (31).

The second adjustment cam (8) penetrates to reach the recess (322) on the extension plate (32) and is linked to the raised portion (42) of the locating plate (4). The second adjustment cam (8) is provided with a second riveting end (81) and a second cam base (82). The second riveting end (81) is linked to the second through hole (421) of the locating plate (4), and the second cam base (82) extends into the second slit (3221) of the extension plate (32).

Figure 5:
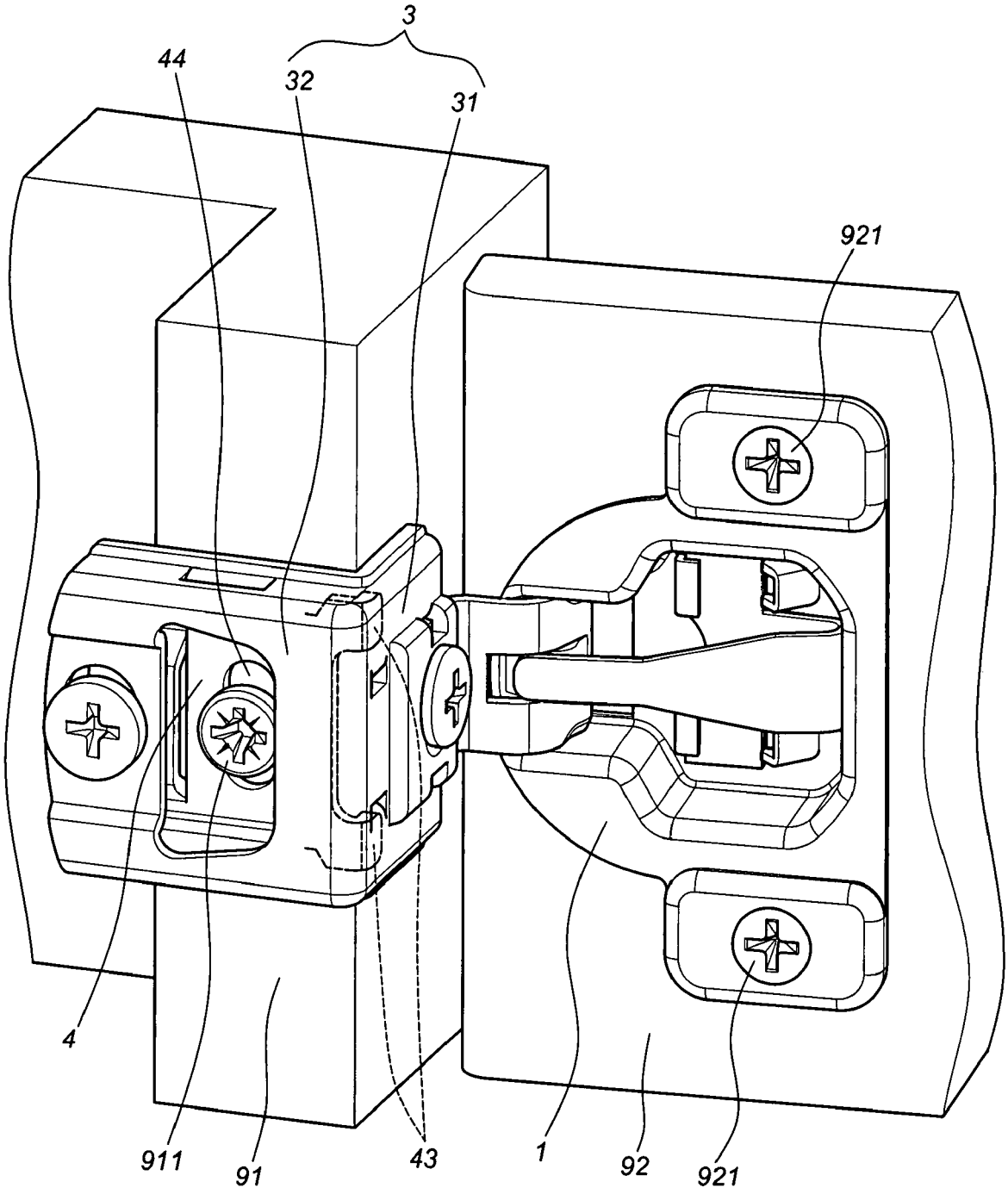
FIG. 5 is a schematic view showing that the preferred embodiment of the present invention is adapted to a cabinet board and a door plank.

Accordingly, when the preferred embodiment is adapted to a cabinet as illustrated in FIG. 5, the hinge of the present invention is abutted to a cabinet board (91) by having the connection plate (31) and the extension plate (32) of the connector (3) erected at a right angle to each other. The retaining tabs (43) of the locating plate (4) hold against a side edge of the cabinet board (91). A bolt (911) penetrates through the strip hole (44) of the locating plate (4) to be fastened to the cabinet board (91). A door plank (92) is connected with the head plate (1) and secured with screws (921).

Figure 6:
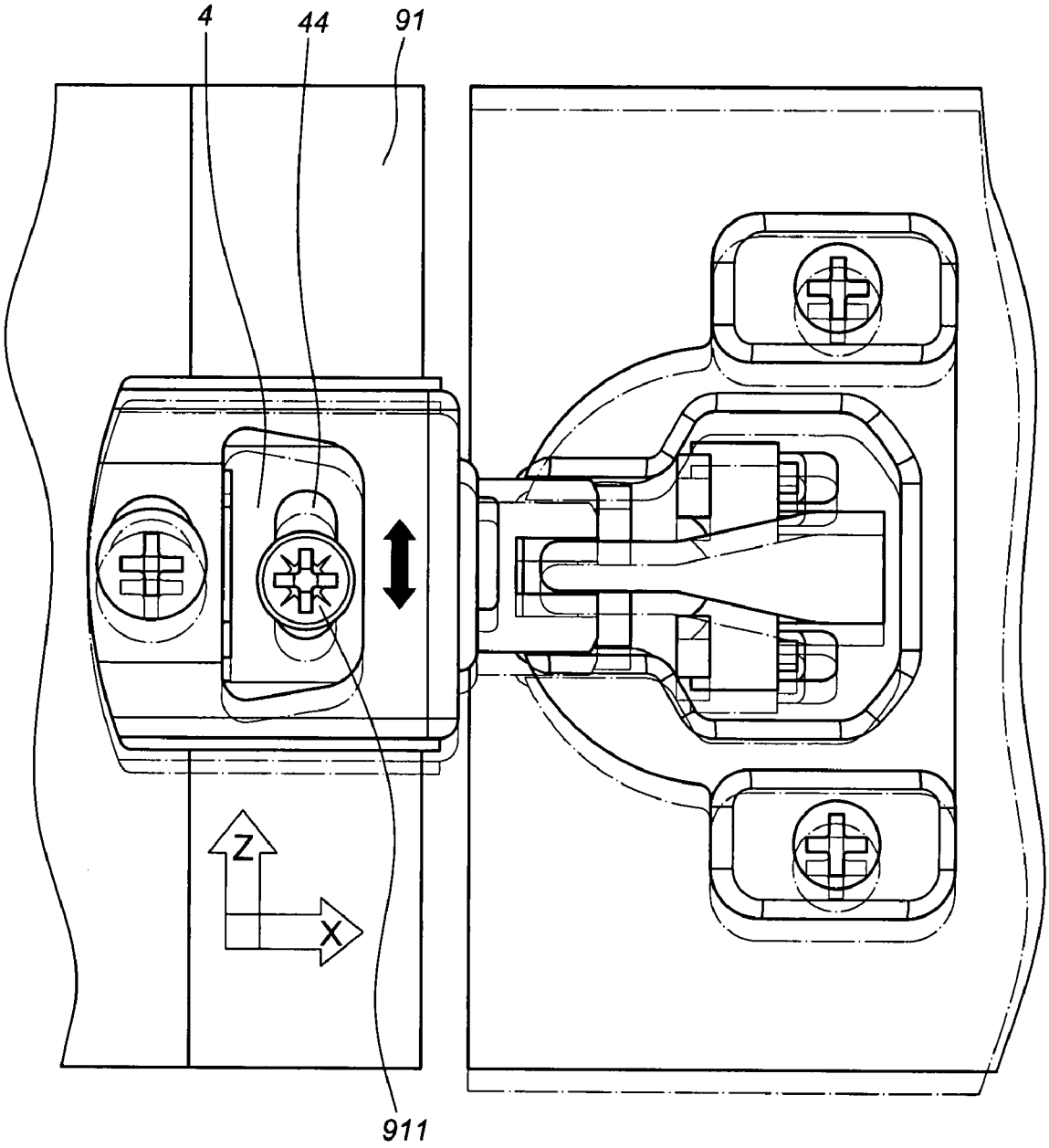
FIG. 6 is a schematic view showing an adjustment made (in the direction of axis Z) by the preferred embodiment of the present invention.

In making an adjustment for the hinge of the present invention as illustrated in FIG. 6, before applying full torque to the bolt (911) mounted to the cabinet board (91) in the strip hole (44) of the locating plate (4), the entire hinge permits adjustment in a direction of axis Z according to the coordinates illustrated in FIG. 6 by taking advantage of a space left in the strip hole (44) of the locating plate (4).

Figure 7:
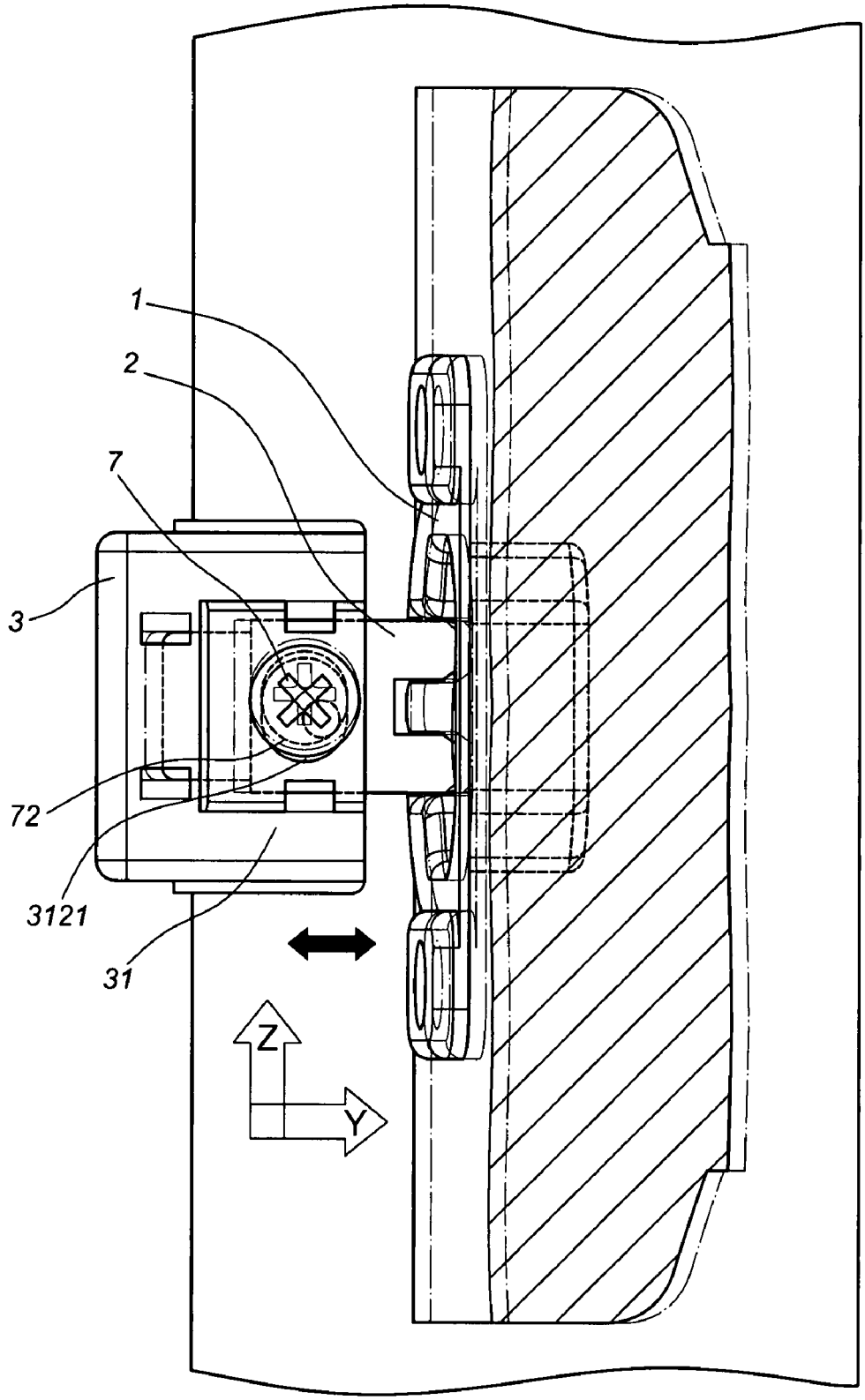
FIG. 7 is a schematic view showing another adjustment made (in the direction of axis Y) by the preferred embodiment of the present invention.

With the connector (3) serving as a reference point without moving as illustrated in FIG. 7, the first adjustment cam (7) is turned for the cam base (71) of the adjustment cam (7) to push against the first slit (3121) of the connection plate (31), allowing the first riveting end (71) of the first adjustment cam (7) to drive the arm (2) and the head plate (1) to execute displacement in a direction of axis Y according to the coordinates illustrated in FIG. 7.

Figure 8:
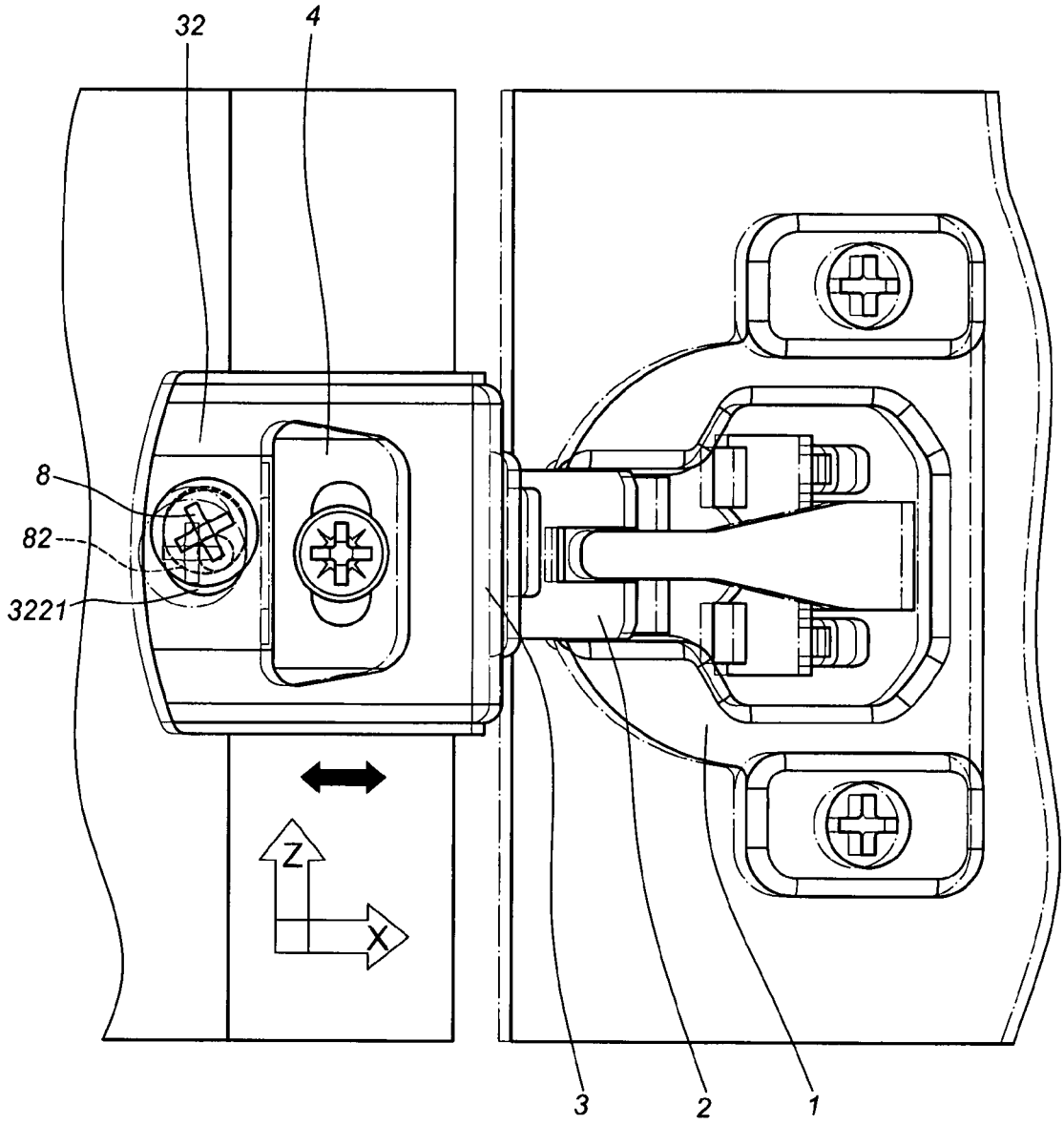
FIG. 8 is a schematic view showing another adjustment yet made (in the direction of axis X) by the preferred embodiment of the present invention.

Furthermore, with the locating plate (4) serving as a reference point without moving as illustrated in FIG. 8, the second adjustment cam (8) is turned for the second cam base (82) of the second adjustment cam (8) in pushing against the second slit (3221) on the extension plate (32) for the connector (3) to drive the arm (2) and the head Plate (1) to execute displacement in a direction of axis X according to the coordinates illustrated in FIG. 8.

What is claimed is:

1. A multi-directional adjustment hinge comprising:

a head plate containing a chamber;

an arm being a bent plate provided with two opposite ends, one end serving as a cam portion and having a slotted opening formed adjacent the cam portion, another end of the arm serving as an insertion portion, the insertion portion having a first plate and a second plate extending distally from the first plate at a different level therefrom;

a connector having a connection plate and an extension plate disposed at a right angle to each other, the connection plate having a recess formed on an inner side thereof with a first pair of spaced apart locking pieces disposed on opposing sides thereof for slidably receiving the first plate of the insertion portion of the arm therebetween and a second pair of spaced apart locking pieces disposed on the inner side of the connection plate for slidably receiving the second plate of the insertion portion of the arm therebetween, the extension plate having a hole being provided at a central portion thereof and a recess being disposed next to the hole, the extension plate having two sidewalls extending from an inner side thereof, each of the sidewalls having a protruding tab formed to project toward the inner side of the extension plate;

a locating plate having two lips formed at two sides thereof, each of the lips having a planar flange bent from a terminal portion thereof, the locating plate having a raised portion disposed between the two lips, the locating plate being inserted between the sidewalls on the inner side of the extension plate, the flanges of the lips being respectively slidably engaged between an inner surface of the extension plate and the protruding tabs, the raised portion being displaceably attached to the recess of the extension plate;

a pivot pin penetrating through the cam portion of the arm and the head plate to pivotally couple the arm to the head plate;

a spring tongue including a locating portion and a force-applying portion at opposing ends thereof with the locating portion being secured in the chamber of the head plate and the force-applying portion penetrating through the slotted opening of the arm and applying a bias force to the cam portion of the arm;

a first adjustment cam penetrating an opening in the connection plate between the locking pieces to displaceably link the connection plate to the insertion portion of the arm;

a second adjustment cam penetrating an opening formed in the recess of the extension plate to displaceably link the extension plate to the raised portion of the locating plate; and a plurality of locating pieces and retainers disposed in the chamber to hold against the locating portion of the spring tongue, the locating pieces compressing the locating portion to secure the spring tongue in position, the retainers being disposed in correspondence to an edge of the locating portion of the spring tongue.

2. The multi-directional adjustment hinge as claimed in claim 1, wherein the connection plate has a raised surface disposed in correspondence to the recess thereof and the first plate of the insertion portion of the arm; the opening formed in the connection plate being disposed in the raised surface; a first through hole is provided on the first plate of the insertion portion; the first adjustment cam is provided with a first riveting end and a first cam base; the first adjustment cam links with the first riveting end to the first through hole of the arm; and the first cam base extends into the opening in the connection plate.

3. The multi-directional adjustment hinge as claimed in claim 1, wherein a second through hole is disposed on the raised portion of the locating plate; the second adjustment cam is provided with a second riveting end and a second cam base; the second adjustment cam links with the second riveting end to the second through hole of the locating plate; and the second cam base extends into the opening in the extension plate.

4. The multi-directional adjustment hinge as claimed in claim 1, wherein the location plate has two retaining tabs and a strip hole disposed on an end portion thereof.

* * * * *